United States Patent [19]

Goodwin et al.

[11] Patent Number: 5,009,739

[45] Date of Patent: Apr. 23, 1991

[54] HAND-HELD LABELER

[75] Inventors: Brent E. Goodwin, Middletown; Donald L. Karn, Springboro; John D. Mistyurik, Tipp City, all of Ohio

[73] Assignee: Monarch Marking Systems, Inc., Dayton, Ohio

[21] Appl. No.: 507,077

[22] Filed: Apr. 10, 1990

Related U.S. Application Data

[63] Continuation of Ser. No. 209,759, Jun. 22, 1988, Pat. No. 4,956,045.

[51] Int. Cl.[5] ..... B65C 11/02

[52] U.S. Cl. ..... 156/384; 15/102; 101/288; 101/425; 156/577; 156/579; 156/DIG. 49

[58] Field of Search ..... 156/384, 577, 579, DIG. 48, 156/DIG. 49; 101/288, 425; 361/214; 15/100, 21 B, 97 R, 102

[56] References Cited

U.S. PATENT DOCUMENTS 4,350,554 9/1982 Pabodie ..... 156/384

4,432,830 2/1984 Jue ..... 156/384

*Primary Examiner*—Michael Wityshyn

*Attorney, Agent, or Firm*—Joseph J. Grass

[57] ABSTRACT

There is disclosed a hand-held labeler having a housing with a handle, a thermal print head for printing on labels of a composite label web, a platen roll cooperable with the print head, a delaminator for delaminating printed labels, an applicator for applying printed labels, and a brake for arresting the platen roll to prevent loss of print registration during application of a label. The operative components of the labeler are readily accessible for servicing, and yet the labeler is simple in construction. The labeler has an improved print head mounting structure for facilitating precise alignment and pressure contact between the print head and the platen roll.

9 Claims, 9 Drawing Sheets

FIG-2
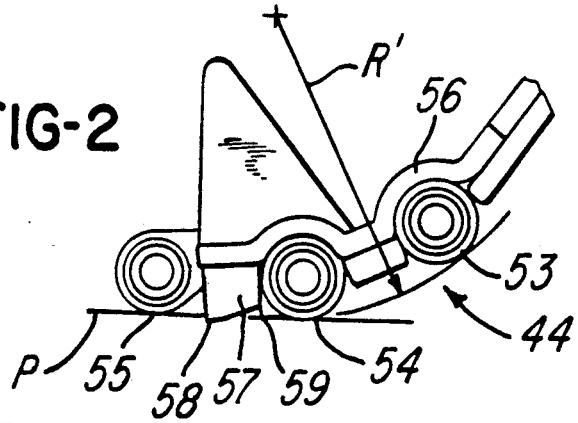
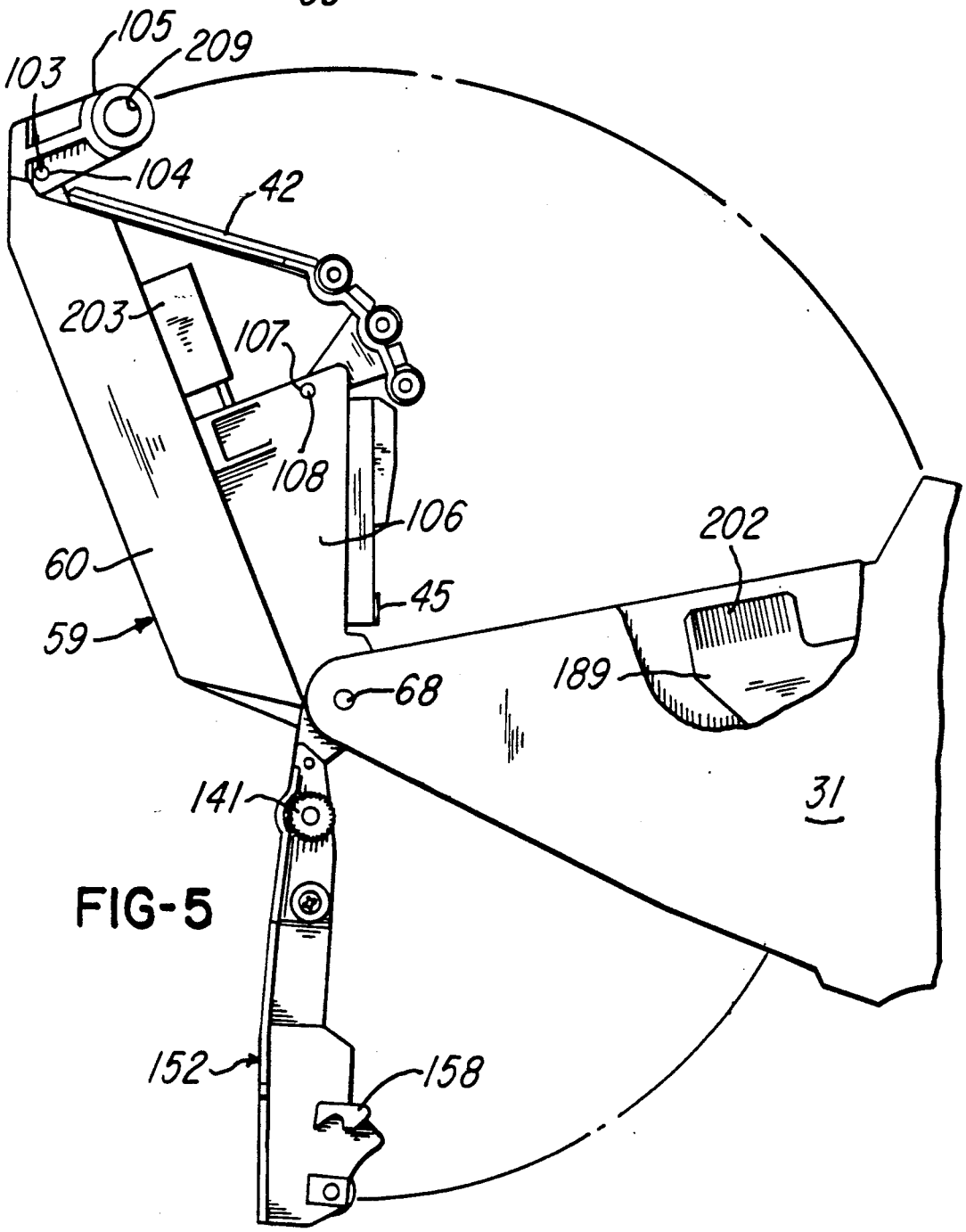
FIG-5

A
SR

HAND-HELD LABELER

CROSS-REFERENCE TO RELATED APPLICATION

This application is a division of U.S. patent application Ser. No. 209,759, filed June 22, 1988, now U.S. Pat. No. 4,956,045.

BACKGROUND OF THE INVENTION

1. Field of the Invention

This invention relates to the field of hand-held labelers.

2. Brief Description of the Prior Art

The following U.S. Pat. Nos. are made of record: 3,686,055 to K. D. Hermann granted Aug. 22, 1972; 3,954,545 to Paul H. Hamisch, Jr. et al granted May 4, 1976; 3,968,745 to Paul H. Hamisch, Jr. granted July 13, 1976; 4,264,396 to Donald S. Stewart granted Apr. 28, 1981; 4,435,245 to G. H. Letz granted Mar. 6, 1984; 4,477,305 to Paul H. Hamisch, Jr. et al granted Oct. 16, 1984; 4,490,206 to James A. Makley granted Dec. 25, 1984; 4,556,442 to Daniel J. Torbeck granted Dec. 3, 1985; and 4,584,047 to James L. Vanderpool et al granted Apr. 22, 1987.

SUMMARY OF THE INVENTION

This invention relates to an improved hand-held labeler which is reliable, easy to use, simple in construction, and which can be operated with a minimum of fatigue.

According to one feature of the invention, there is provided a hand-held thermographic labeler which has a brake mechanism for preventing a printed label from pulling the composite label web from the supply roll during application of a printed label to avoid misregistration of the next label with respect to the thermal print head, wherein the brake mechanism is mechanically operated to effect braking and is electricaly operated to remove the braking force. The brake mechanism is preferably effective essentially at all times except when it is desired to advance the composite web. According to a preferred embodiment, the disablement of the brake mechanism is accomplished by an electromagnetic device, for example, a solenoid. The solenoid has relatively small power requirements. It is preferred that the plunge of the solenoid move through a distance before the brake mechanism is moved so that the inertia of the plunger can be used to disable the brake mechanism. Also in accordance with the preferred embodiment the brake mechanism acts on a platen roll which cooperates with the thermographic print head. Accordingly, the platen roll is used not only for the printing operation, but it is used to apply the braking force to the composite label web. The brake mechanism includes an arrangement whereby there is virtually no forward movement of the platen roll when the brake mechanism is applied.

Another feature of the invention is the provision of a brake that maintains the web immovable at all times except essentially when the web is being driven during a printing cycle in order to assure that the registration between the print head and the record members on the web is maintained. To conserve power, the brake mechanism is biased to maintain the braking force normally applied, with the braking force being electrically removed only during the printing cycle, and under the control of a microprocessor.

It is another feature of the invention to provide a hand-held labeler which can be readily serviced because major operative components can be moved to accessible positions. Because of the detachable connectors, servicing can be accomplished without loss of the labeler's memory and without the complexity of a maze of wires. In addition, the connectors are so constructed that the coupling between different portions of the circuit can be effected even though various labeler components have manufacturing inaccuracies. In this regard, at least one of the connectors is mounted for limited floating movement to help accommodate misalignment between the connectors. It is also preferred that the connectors have a provision for camming each other into alignment in the event of this misalignment of the connectors.

It is preferred to provide a hand-held labeler in which the print head can be readily accessed by mounting the print head for movement between a first position and a second printing position with the print head away from the platen. It is also preferred that the platen be movable away from the print head and it is most preferred that both the print head and the platen be independently and individually movable away from each other to allow the greatest access for servicing.

It is yet another feature of the invention to provide for improved print head adjustment and control so that not only can the line of printing elements be brought into precise alignment with the axis of the platen roll, but the pressure exerted by the platen against the line of printing elements can be uniform throughout the length of the line and this be accomplished by simple structure.

It is still another feature of the invention to provide a hand-held labeler which can accept label supplies having a variety of thicknesses including labels having resonant circuits useable in electronical article surveillance systems. There is provision for providing a gradual transition of the composite web between the place where the composite web is paid out of the supply roll and the print head. This gradual transition by a guide with a plurality of rollers assures that the relatively thick labels will not be adversely affected when they pass through the labeler. It is also preferred to provide a wiper which will allow a definite small amount of wiping action as the composite web passes toward the print head.

It is another feature of the invention to provide method and apparatus for preventing damage to the thermal labeler circuitry, including the memory and data contained therein, resulting from electrostatic discharge. During normal use, electrostatic charges build up in a totally portable battery powered hand-held thermal labeler because the labeler is not connected to ground. Electrostatic charges result mainly from the passage of the carrier through the labeler and from friction between plastic parts. Electrostatic charges result especially when the ambient air is dry. The housing of such thermal labelers is constructed of molded plastic material. In that the plastic housing is itself an effective insulator, the electrostatic charge can build up in the labeler circuitry until there is an abrupt electrostatic discharge or arc between components of the circuitry. In accordance with the invention, there is provided an arrangement in which the electrostatic charge is drained away to the user of the labeler before the charge is built up to a detrimental level.

Other features advantages and objects will be readily apparent to those skilled in the art from a reading of the following description.

BRIEF DESCRIPTION OF THE DRAWINGS

FIG. 2 is a fragmentary view of a guide also shown in FIG. 1;

FIG. 5 is a fragmentary side elevational view showing both mounting sections of the labeler in respective open positions for ready access purposes;

DETAILED DESCRIPTION OF THE PREFERRED EMBODIMENT

Figure 1:
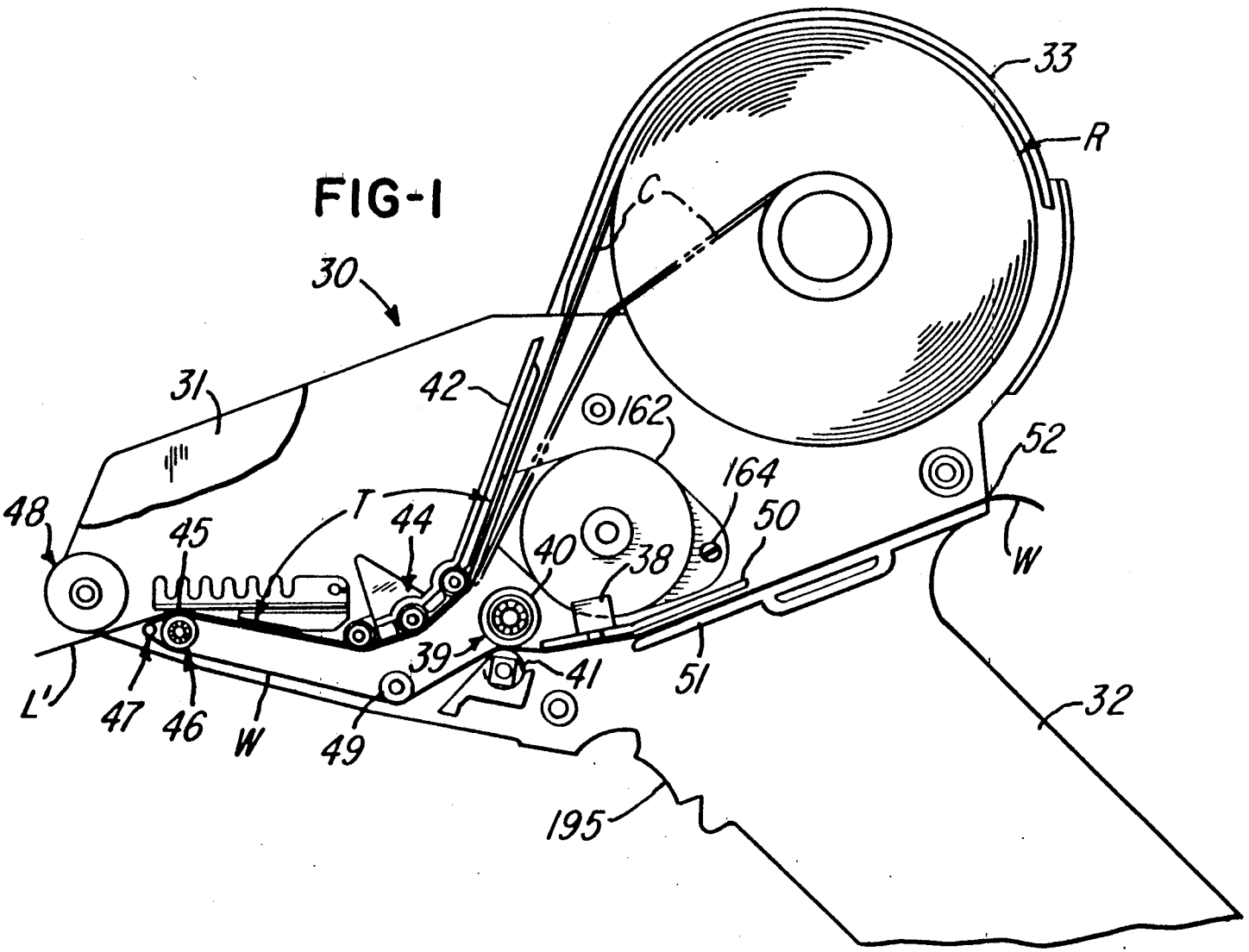
FIG. 1 is a diagrammatic side elevational view of a hand-held labeler in accordance with an embodiment of the invention.
Figure 13:
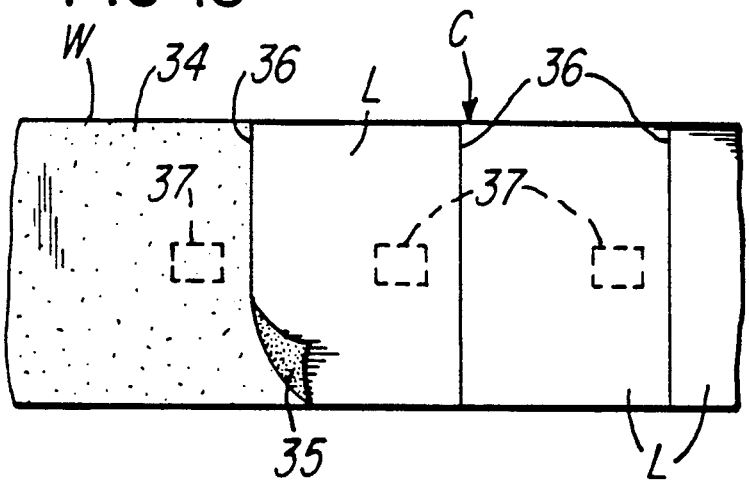
FIG. 13 is a top plan view showing a fragmentary portion of the composite label web.
Figure 14:
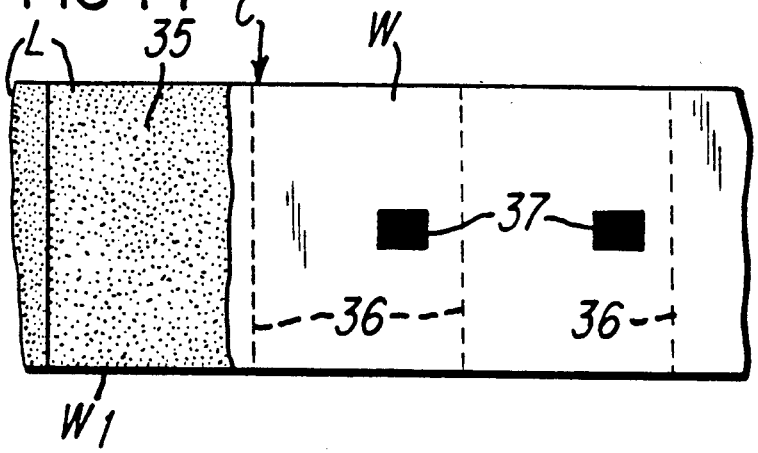
FIG. 14 is a bottom plan view of the composite label web shown in FIG. 13.

With reference initially to FIG. 1 there is shown a hand-held labeler generally indicated at 30. The labeler 30 includes a frame or housing 31 having a handle 32. The housing 31 suitably mounts a label supply roll R. The roll R is shielded from ambient conditions such as dust by a cover 33. The roll R is comprised of a composite label web C shown in both solid lines representing a full roll R and phantom lines representing a nearly fully depleted roll R. The composite web C is shown in FIG. 13 to include a carrier web W having a coating of release material 34 such as silicone indicated by light stippling. Labels L are releasably secured by pressure sensitive adhesive 35 indicated by heavy stippling to the release material 34. The labels L are formed from a web W1 of label material severed by complete lines of severing 36. The lines of complete severing 36 are hidden in FIG. 14 and thus are shown by broken lines. Marks 37 preferably on the underside of the carrier web W are solid and rectangular and are adapted to be sensed by an optical sensor 38 (FIGS. 1 and 6) for the purpose of controlling various labeler functions. The marks 37 are hidden in FIG. 13 and thus are shown by broken lines.

Figures 6, 7:
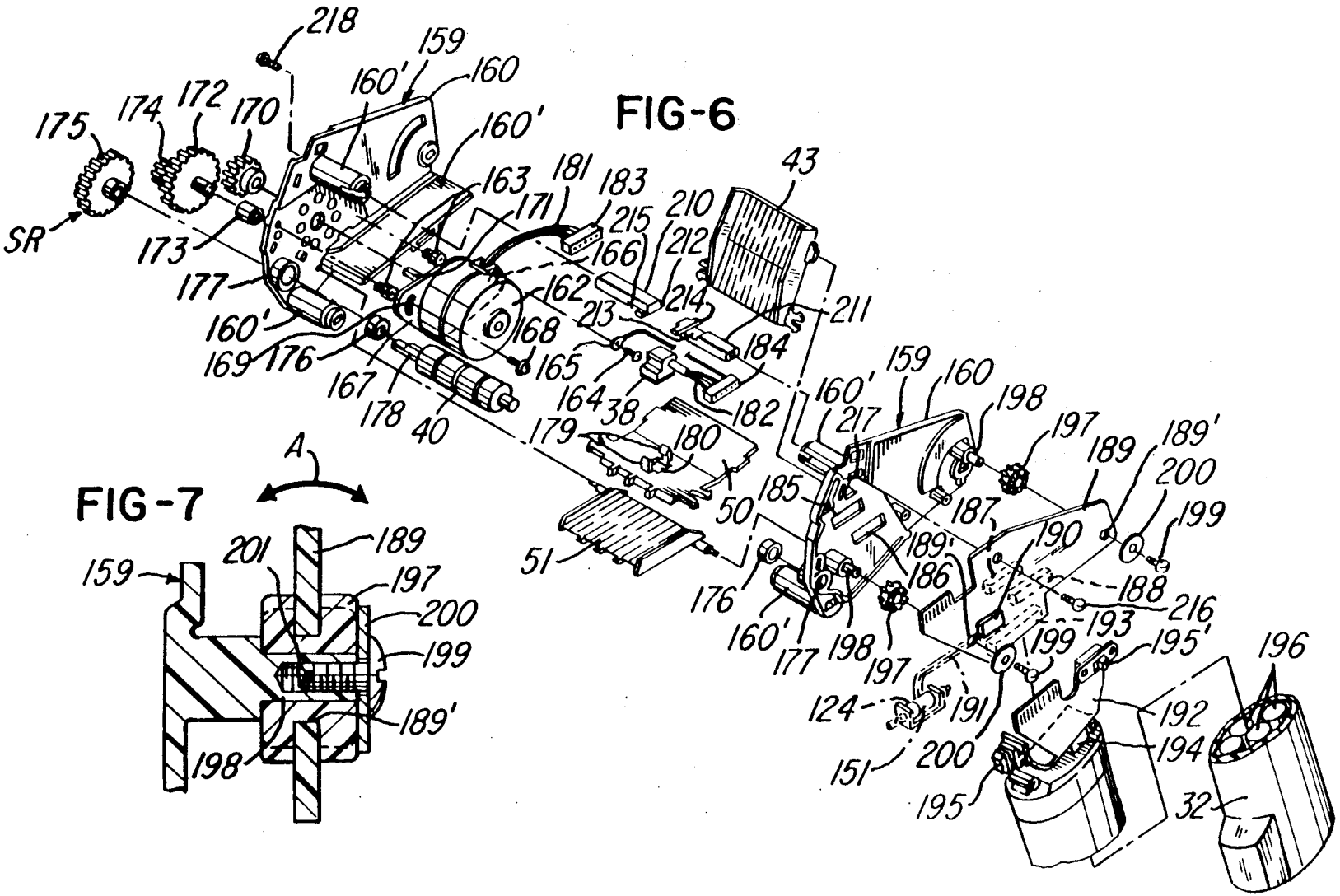
FIG. 6 an exploded perspective view showing various components including components of the composite web advancing mechanism and associated electrical components.
FIG. 7 is a sectional view showing structure for mounting a printed circuit board on the housing.
Figure 8:
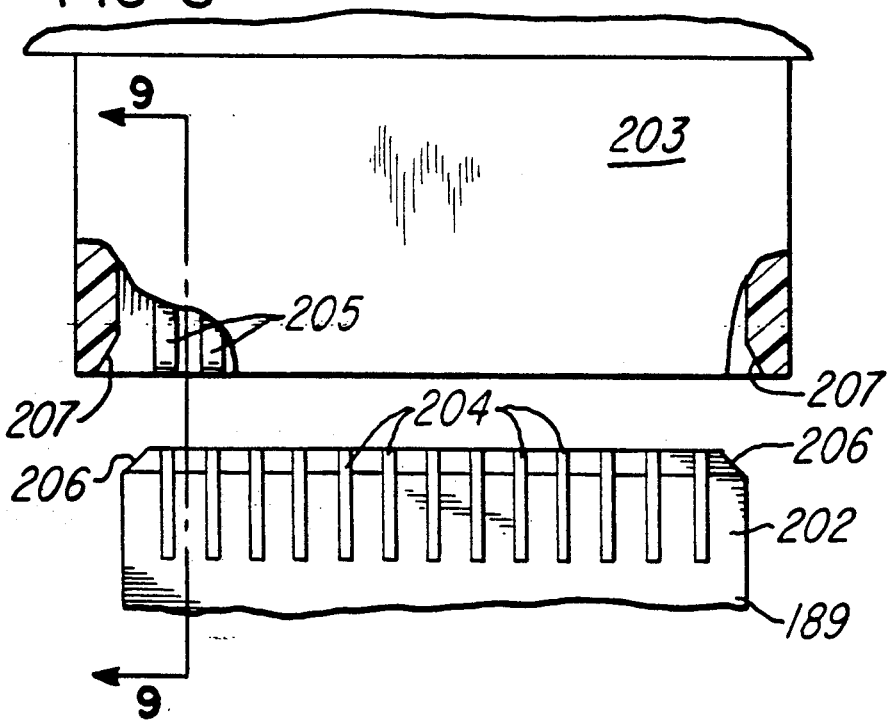
FIG. 8 is a fragmentary elevational view showing the structure by which two portions of a control circuit are detachably connected.
Figure 9:
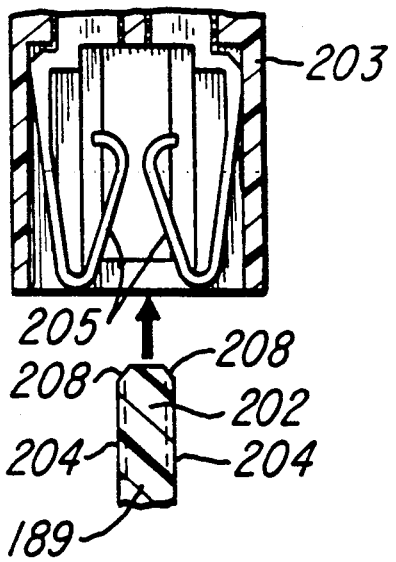
FIG. 9 is a fragmentary sectional view taken along line 9—9 of FIG. 8.

The composite label web C is paid out of the roll R when an advancing or feeding mechanism generally indicated at 39 is operated. The feeding mechanism 39 includes a resilient driving roll 40 and a cooperating serrated metal idler roll 41. The composite web C passes from the roll R to between a pair of spaced guides 42 and 43 (FIG. 6). From there the composite web C makes a gradual transition as it passes about the guide 42. The guides 42 and 43 and a guide 44 define a path for the composite web C between the place where the composite web C is paid out of the roll R on the one hand and a print head 45 and a cooperating platen generally indicated at 46 on the other hand. The print head 45 has a straight line of closely spaced printing elements (not shown) which extends perpendicular to the path of travel of the composite web C. The transition made by the composite web C is through an angle T not less than 85° and preferably about 96° assuming a full label supply roll R, and in addition, it is preferred that the radius R' of the path be not less than 18 millimeters and most preferably about 25 millimeters. A delaminator generally indicated at 47 is shown to comprise a peel roller 47' (FIG. 4) positioned closely adjacent the line of pressure contact between the print head 45 and the platen 46. The carrier web W passes partly about the delaminator 47 to effect delamination of the leading label L'. The leading label L' is dispensed into label applying relationship with respect to an applicator generally indicated at 48. From the delaminator 47 the carrier web W passes again into contact with the platen 46 and from there partly about a guide roller 49 to between the nip of the rolls 40 and 41. The carrier web W has enough stiffness to be pushed along guides 50 and 51 and to exit through an exit opening 52 in the housing 31 at a point above and behind the handle 32.

With reference to FIG. 2, the guide is shown to include three freely rotatable rolls 53, 54 and 55 rotatably mounted in the guide 42. The guide 42 mounts a wiper 57 composed of a low permeable urethane material which wipes across the face of the advancing labels L. This material has cavities or pockets which catch the dust or dirt in the labels L as the composite web C advances. The wiper 57 is adhesively and removably adhered to the guide 42. A plane P is shown to extend across the tangents of rolls 54 and 55 where the labels L are in guided contact. The wiper 57 is shown to project slightly through the plane P of the advancing labels L. While it is known in the prior art to provide a thermal hand-held labeler with a wiper to remove dust or dirt from the labels, the invention involves the position of the wiper 57 between the rolls 54 and 55 so that just the right amount of wiping action takes place. The position of the rolls 54 and 55 relative to outer surface 58 of the wiper 57 determines the amount of wiping contact. As shown, the surface 58 is inclined with respect to the plane P to provide a gradual entry for the advancing web C. This gradual entry facilitates threading of the labeler 30. As shown the entry end 59' of the surface 58 is above the plane P in FIG. 2 to facilitate threading of the web C.

Figure 3:
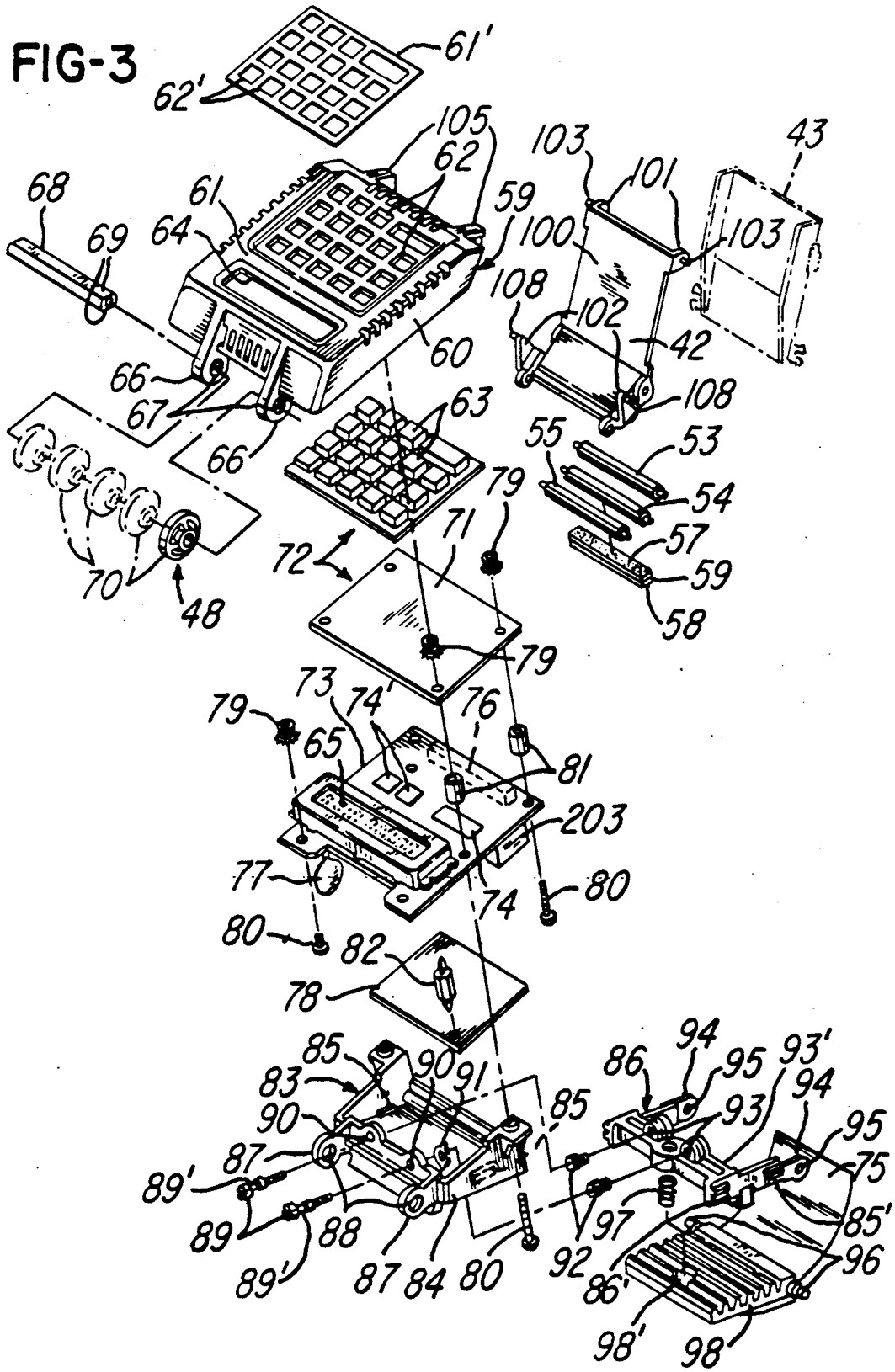
FIG. 3 is an exploded perspective view of one of the mounting sections on which various components are mounted.

With reference to FIG. 3, there is shown a section generally indicated at 59 for mounting various components. The section 59 helps to protect such components from damage and ambient contamination and can be considered to constitute an outer part of the housing 31, if desired. The section 59 is shown to include a generally box-like member 60 having a wall portion 61 having openings 62. Key pads 63 project through the openings 62, and an opening 64 receives a display 65. A grid-like sheet 61' has holes 62' aligned with holes 62. The holes 61' receive the key pads 63. Different areas of the sheet 61' are color coded to avoid the need for color-coding the key pads 63. The member 60 has a pair of spaced tabs 66 with aligned holes 67 for receiving a shaft 68 having flats 69. The flats 69 key the shaft 68 to the housing 31 against rotation. The shaft 68 passes through a series of rotatable applicator rollers 70 which comprise the applicator 48. The section 59 can pivot about the shaft 68 between its normally closed or operative position (FIG. 1) to its open position (FIG. 5).

The keypads 63 and a cooperating printed circuit board 71 constitute a keyboard generally indicated at 72. Another printed circuit board 73 mounts the display 65, a microprocessor 74 and various other electric components 74' which are diagrammatically illustrated. The print head 45 is connected by a ribbon connector 75 to a plug-in type connector 76 which in turn is connected to the microprocessor 74. The printed circuit board 73 also mounts an auxiliary or backup lithium battery 77 for powering the microprocessor 74 when other power to the microprocessor 74 is interrupted. Additional memory is contained in printed circuit board 78. The printed circuit boards 71 and 73 are secured to the section 59 by fasteners 79 secured to the inside of the section 59 by screws 80 received by the fasteners 79 and by spacers 81. The printed circuit board 78 is secured at two places to the printed circuit board 73 by stand-offs 82 only one of which is shown.

A support generally indicated at 83 is shown to include a member 84 having spaced guides 85 for loosely and slidably guiding a mounting member generally indicated at 86. The guides 85 fit into oversize grooves 85' only one of which is shown. The member 84 has spaced tabs 87 having aligned round holes 88 which receive the shaft 68. Two screws 80 secure the support 83 to the section 59. A pair of adjusting screws 89 pass through oversize holes 90 in the member 84, through C-rings 91 and are threadably received in threaded members 92 secured in holes 93 in the mounting member 86. The C-rings 91 are received in grooves 89' in the screws 89 to prevent shifting of the screws 89 axially of the holes 90. Because of the loose sliding fit between the members 84 and 86, rotation of the screws 92, or either one of them, can skew the member 86 to in turn bring the straight line of printing elements on the print head 45 into alignment with axis A of the platen roll 46'. The mounting member 86 has a pair of spaced arms 94 with round holes 95 which receive aligned studs 96. A compression spring 97 acting on the member 86 midway between arms 94 and a metal heat sink 98 which mounts the print head 45, urges the print head 45 into pressure contact with the platen roll 46' along a line of contact. The spring 97 also enables the print head to yield to accommodate thick labels. The spring 97 nests in a pocket (not shown) in the mounting member 86 and in a pocket 98' in the heat sink 98. A unique feature of the invention is that the print head mounting member 86 can change shape. The member 86 is preferably constructed of molded plastics material and is of generally U-shaped configuration. The member 86 is preferably relatively flexible and resilient and can twist to enable the print head 45 to compensate for variations between the print head 45 and platen roll 46' due for example to manufacturing variations. As shown, the arms 94 are parallel to each other but they can skew due to their flexible and resilient construction. Each arm 94 is joined to a bight portion 93'. Each arm 94 has a hook-like member 86' which snaps under the heat sink 98 to couple the mounting member 86 to the heat sink 98. The members 86' allow for limited movement between the member 86 and the heat sink 87 but prevent their separation.

The guide 42 is shown in FIG. 3 to have a body 100 with a pair of tabs 101 at its one end portion and a pair of tabs 102 at its other end portion. The tabs 101 have studs 103 received in aligned holes 104 (FIG. 5) in tabs 105 on member 60. The member 83 also has projections 106 having holes 107 for receiving studs 108 on tabs 102. The guide 42 is thus pivotal about studs 103 on the member 60, and by flexing the tabs 102 toward each other the studs 108 can be aligned with and inserted into the holes 107 to retain the holder 56 in its operative position or the tabs 102 can be flexed toward each other to enable the studs 108 to be withdrawn from the holes 107 to enable the holder 56 to be pivoted away to allow access to the printed circuit boards 71, 73 and 78 for ease of access and disassembly.

Figure 4:
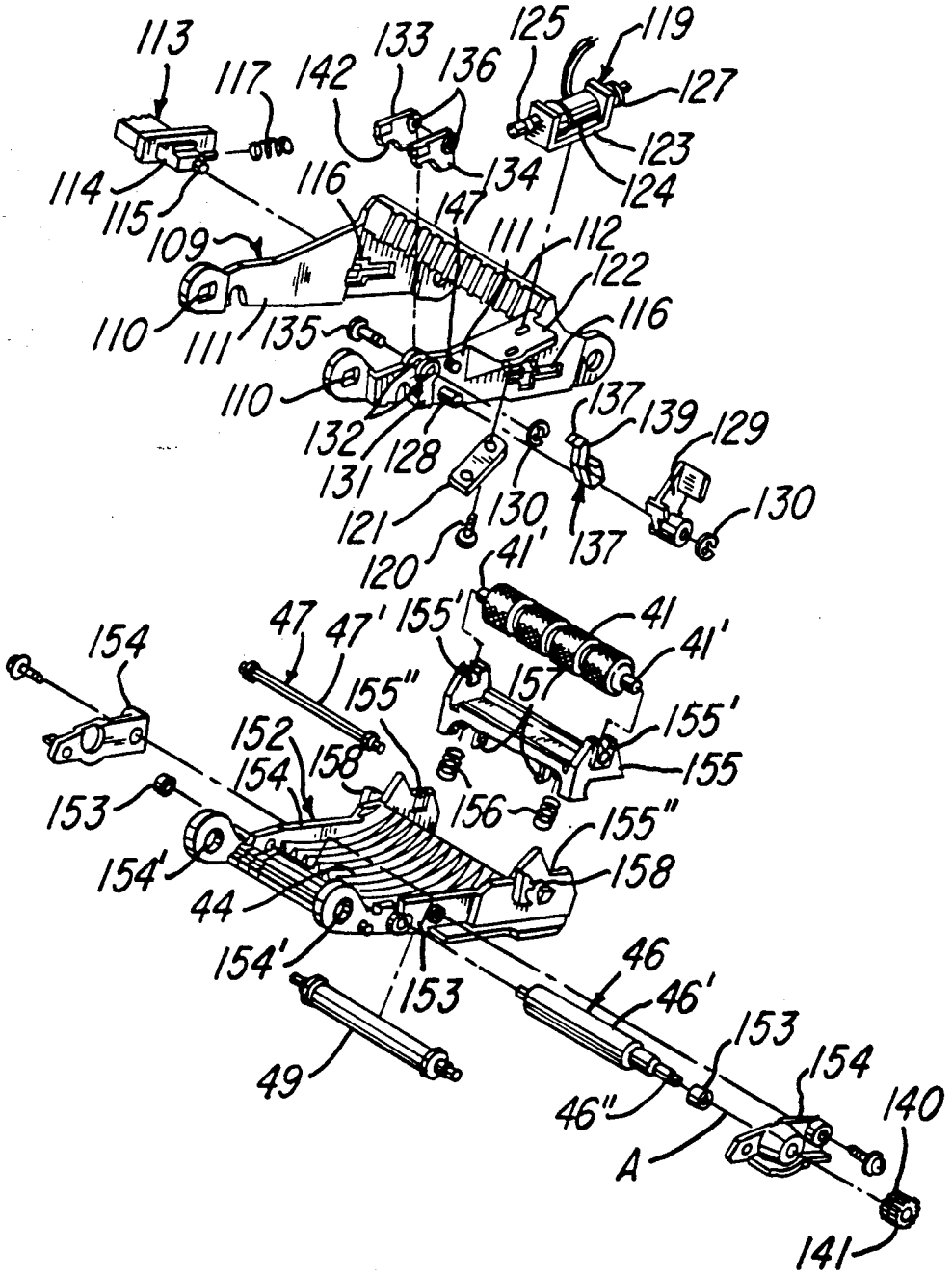
FIG. 4 is an exploded perspective view of the other mounting section on which various other components are mounted.
Figure 10:
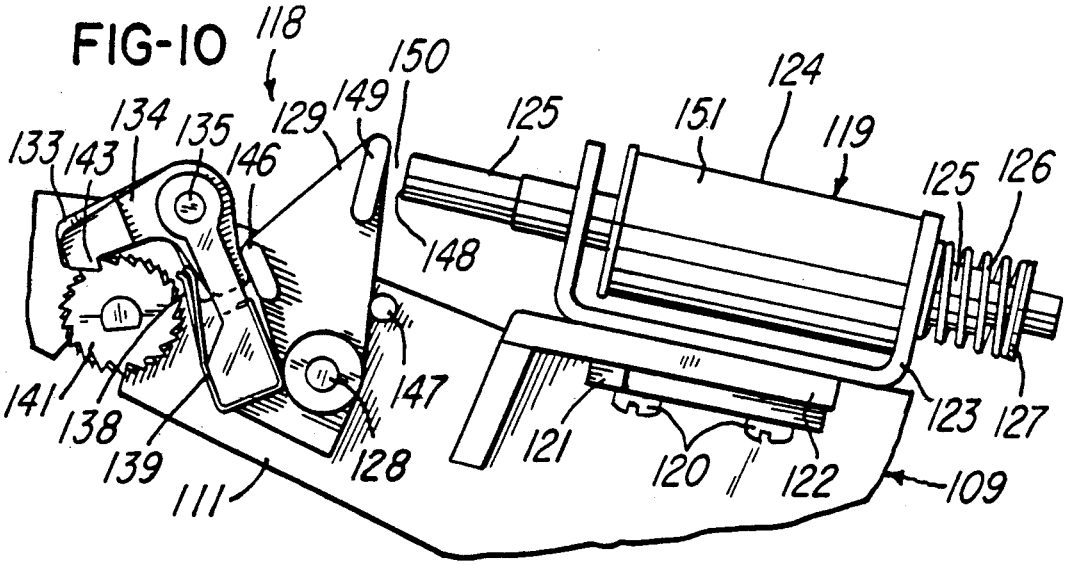
FIG. 10 is a fragmentary side elevational view of a brake mechanism for preventing loss of registration of the labels with respect to the thermal print head, with the brake mechanism being shown in its braking or actuated position.
Figure 11:
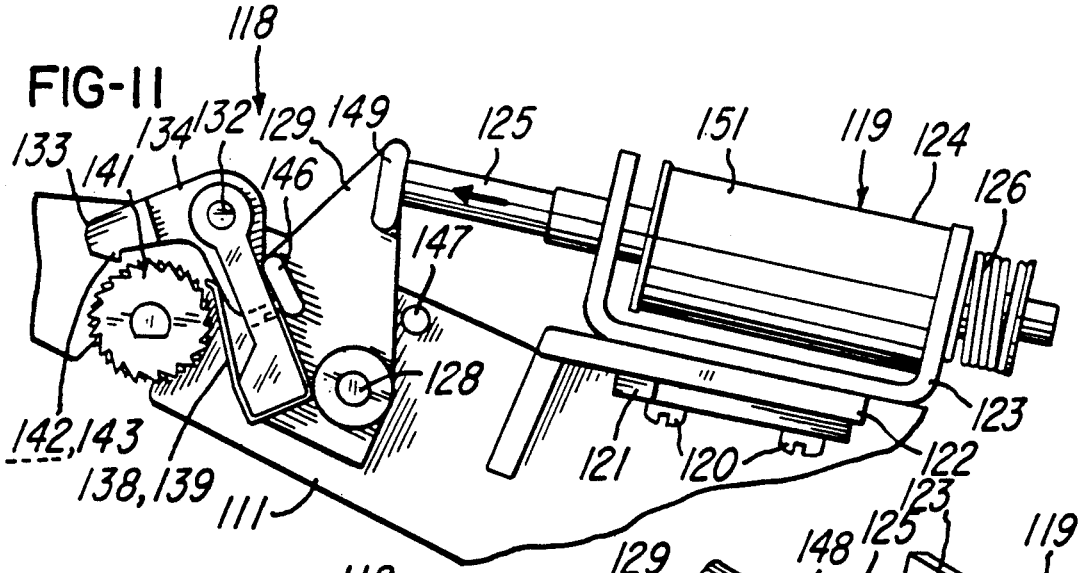
FIG. 11 is a view similar to FIG. 10 but showing the brake mechanism in its non-braking or deactivated position.
Figure 12:
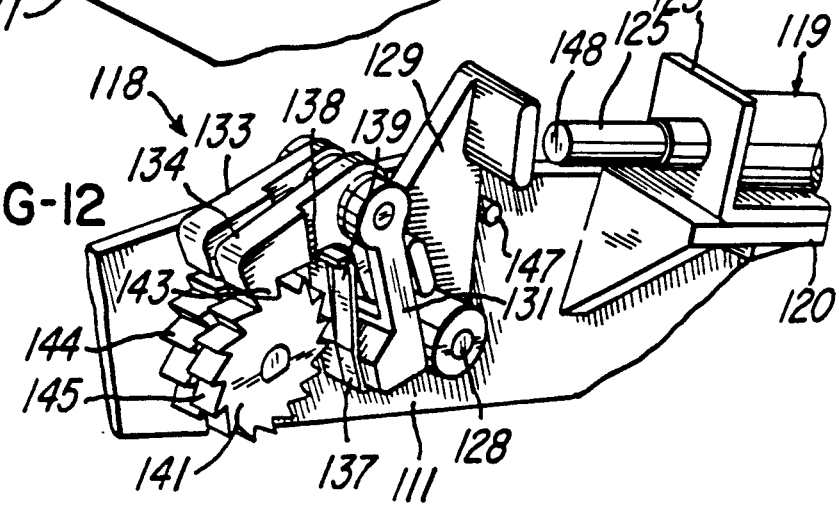
FIG. 12 is a fragmentary perspective view of the brake mechanism in its braking position.

With reference to FIG. 4, a support generally indicated at 109 is fixed to the housing 31 by suitable means including the shaft 68 which passes through non-circular holes 110. The support 109 is generally U-shaped and includes a pair of arms 111 and a connecting bar 112. A pair of opposed manually operable latches 113 (only one of which is shown) is mounted in arms 111. Each latch 113 includes a slider 114 with a latch pin 115. Each slider 114 is slidably received in a slot 116 in the respective arm 111 and is urged generally to the left as viewed in FIG. 4 by a compression spring 117. The support 109 also mounts part of a brake mechanism generally indicated at 118 and shown in detail in FIGS. 10 through 12. The brake mechanism 118 is operated by an electromagnetic device or actuator generally indicated at 119 mounted on the support 109. Screws 120 pass through a washer plate 121 and through a tab 122 on the support 109 and are threadably received by a U-shaped bracket 123. The electromagnetic device 119 includes a solenoid 124 having a movable plunger or core 125. The plunger 125 can have a cap (not shown) which serves as a stop. A compression spring 126 on the plunger 125 bears against the bracket 123 and a ring 127 fixed to the plunger 125. In the deactivated position of the device 119, the spring 125 moves the plunger 126 to the position shown in FIG. 10. Projecting from the arm 111 is a post or shaft 128 which pivotally mounts a lever 129. An E-ring 130 maintains the lever 129 on the shaft 128. A generally U-shaped member 131 is formed on the arm 111 and has aligned holes 132. A pair of levers or pawls 133 and 134 is mounted in the space within the U-shaped member 131. A pin 135 passes through the holes 132 and holes 136 in the levers 133 and 134. A bifurcated leaf spring 137 has separate leaves 138 and 139 which bias the respective levers 133 and 134 counterclockwise in FIGS. 4, 10, 11 and 12 into contact with respective unitarily molded brake wheels 140 and 141. As shown, the levers 133 and 134 are generally L-shaped and have respective teeth 142 and 143. The brake wheels 140 and 141 have respective teeth 144 and 145. The levers 133 and 134 are individually biased by means of the springs 138 and 139 into contact with a projection 146 on the lever 129. As shown in FIGS. 10 and 12, the leaf springs 138 and 139 cause the teeth 142 and 145 to contact the brake wheels 140 and 141. In order to obtain precise braking at any rotational position of the platen roll 46', the teeth 144 are relatively small or fine and the teeth 145 are also relatively small or fine, but in addition the teeth 144 and 145 are offset by one-half tooth pitch. The pitch is the tooth-to-tooth distance from tooth-end to tooth-end. Because the levers 133 and 134 are identical and are mounted coaxially only one lever 133 or 134 will be engaged with a tooth 144 or 145 and the other lever 134 or 133 will be in contact with a tooth 145 or 144 but will not be engaged. With reference to FIG. 10, the tooth 143 is engaged with a tooth 145, whereas the tooth 142 on the lever 133 will contact but will not be engaged with a tooth 144. Thus, in this example, only the lever 134 effects braking. It is seen in FIG. 10 that the leaf spring 139 urges the lever 134 counterclockwise into contact with the projection 146 and in turn the lever 129 is urged clockwise against a stop 147 on the arm 111. It is also seen in FIG. 10 that terminal end 148 of the plunger 125 is spaced from an anvil 149 on the lever 129 to provide a lost-motion connection 150. The electromagnetic force exerted by winding 151 of the solenoid 124 upon the plunger 125 is relatively small. When the winding 151 is initially energized, the force exerted on the plunger is low. As energization in the winding continues, the electromagnetic force exerted by the winding 151 on the plunger 125 increases, so therefore it is very advantageous to enable the plunger 125 to travel a certain distance before the plunger 125 strikes the anvil 149. This is especially advantageous in the hand-held labeler of the invention where the physical size, weight and energy consumption of electrical components are to be kept as small as possible. When the plunger 125 strikes the anvil 149, the lever 129 is pivoted counterclockwise and both levers 133 and 143 are pivoted clockwise to the position shown in FIG. 11 against the biasing action of the leaf springs 138 and 139. As soon as the teeth 142 and 143 move clear of the teeth 144 and 145, the platen roll 46' is free to rotate. It is preferred that the levers 133 and 134 move clear of the teeth 144 and 145 only a short time interval before the advancing mechanism 39 advances the web W, that the winding 151 remain energized during advance of the web W to the extent that the plunger 125 remains in the position shown in FIG. 11, and that the winding 151 cease to be energized to enable one of the teeth 142 or 143 to engage a respective tooth 144 or 145 upon completion of the advance of the web W. The brake mechanism 118 is intended to be operative essentially at all times except when the web W is being advanced by the advancing mechanism 39. The brake mechanism 118 is effective to prevent advance of the web W by mechanical force alone, namely by the force exerted by one of the springs 138 or 139. The brake mechanism 118 is deactivated or inhibited by means of electrical energy only when the winding 151 is energized.

It is shown that the teeth 144 and 145 have a rake angle to prevent the brake wheels 140 and 141 and hence the platen roll 46' from rotating forward or counterclockwise in FIGS. 4, 10, 11 and 12. Thus, pulling of the composite web from the roll R during application of the leading label L' is prevented to in turn prevent misregistration of the next label with the print head 45.

With reference to FIG. 4, the platen roll 46' is mounted on a mounting member generally indicated at 152. The member 152 mounts a pair of bearings 153. Retainers 154 hold the bearings 153 in position. The platen roll shaft 46'' extends through one retainer 154 and the platen roll 46' and brake wheels 140 and 141 are secured against rotation on and relative to the shaft 46''.

The roll 41 is rotatably mounted in a bracket member 155. The member 155 is biased upwardly as viewed in FIG. 4 by spaced compression springs 156 which bear against a shelf (not shown) on the member 152. The upward movement of the member 155 relative to that shelf is limited by hooks 157. Thus, the roll 41 is resiliently biased against the roll 40. End portions 41' of the roll 41 are snap-fitted into snap sockets 155' and are rotatable therein. The member 152 also mounts the guide roll 49.

With reference to FIG. 5, the mounting member 59 as well as the mounting member 152 are shown in their open or non-operating positions. All of the structure illustrated in FIG. 3 except guide 43 have been pivoted to the open position to expose the print head 45 and the interior of the housing 31, and the mounting member 152 and components mounted thereon as illustrated in FIG. 4 have been pivoted to the open position to expose the platen 46, the roll 41 and the interior of the housing 31. The mounting member 152 pivots about the shaft 68 which passes through round holes 154'. When the mounting member 152 has been pivoted to the open or non-operating position shown in FIG. 5, the brake mechanism 118 on the mounting member 152 is separated from the electromagnetic device mounted on the support 109. When the mounting member 152 is moved to its operative position as in FIG. 1, teeth 158 (FIGS. 4 and 5) cooperate with respective pins 115 (FIG. 4) to hold the mounting member 152 latched to the support 109.

With reference to FIG. 6, there is shown a subframe generally indicated at 159 disposed within the frame or housing 31. The subframe 159 includes a pair of subframe sections 160 connected in spaced relationship by connectors 160'. An electric motor 162 is secured to the section 160. A pair of internally threaded studs 163 is secured to one section 160. A screw 164 passes through a motor temperature sensor 165 and a hole 166 in a motor flange plate 167 and is threadably received by the associated stud 163. Another screw 168 passes through an arcuate slot 169 in the flange plate 167 and is threadably received in the associated stud 163. A gear 170 is secured against rotation on and with respect to output shaft 171 of the motor 162. The gear 170 meshes with a larger gear 172 rotatably mounted in a bearing 173 secured to the respective section 160. Coaxially secured to the gear 172 is a smaller gear 174 which meshes with a larger gear 175. The gears 170, 172, 174 and 175 result in speed reduction and constitute a speed reducer SR. Bearing 176 received in hole 177 in the one section 160 rotatably mounts the roll 40. The roll 40 has a shaft 178 received in the bearing 176 and is secured to the gear 175. Thus, rotation of the motor shaft 171 causes the speed reducer SR to rotate the drive roll 40.

The optical sensor 38 is connected by snap fasteners 179 to the guide 50. There is a window 180 in the guide 50 through which the sensor 38 can sense the presence or absence of the marks 37 on the underside of the carrier web W. The motor 162 and the sensor 38 have respective conductors 181 and 182 connected to respective connectors 183 and 184. The connectors 183 and 184 pass through respective openings 185 and 186 and plug into plug-in type connectors 187 and 188 on a printed circuit board 189. The winding 151 of the solenoid 124 is connected to a connector 190 by conductors 191. The printed circuit board 189 also contains electronic components for controlling the electric motor 162. A flexible ribbon connector 192 is detachably plugged into a connector 193 on the printed circuit board 189. The ribbon connector 192 is electrically connected to a connector 194 and to a manually operable trigger or switch 195 which is used to initiate a printing and feeding cycle. An on/off switch 195' is also connected to the ribbon connector 192. The connector 194 is connected to a source of electrical energy illustrated to be rechargeable batteries 196 in the detachably connected handle 32. A handle 32 with discharged batteries 196 can be detached and replaced by a handle with charged batteries, and the handle with discharged batteries 196 can meanwhile be recharged.

The printed circuit board 189 is mounted for limited floating movement to the section 160 of the subframe 159 by a pair of resilient elastomeric bushings 197. The bushings 197 are forced through holes 189' in the printed circuit board 189 and are received on posts or studs 198. Screws 199 pass through washers 200 and are threadably received in the studs 198. The printed circuit board 189 can pivot slightly about a line extending through the centers of the studs 198. This line is indicated at a point 201 in FIG. 7. The washer 200 helps provide restraint to the pivotal floating movement of the printed circuit board 189 so that the pivoting is only slight in the directions of double headed arrow A. The ribbon connector 192 enables the printed circuit board 189 to pivot. As shown in FIGS. 5, 6, 8 and 9, the printed circuit board 189 has a male-type connector 202. The connector 202 can be detachably connected or coupled to a female-type connector 203. The connector 202 has a series of contacts 204 aligned with resilient contacts 205 when coupled. The connector 202 has cam faces 206 at its opposite ends cooperable with cams 207 on the connector 203 to facilitate the coupling. The connector 202 also has cam faces 208 which cooperate with the converging contacts 205 which can result in the above-described pivoting of the printed circuit board 189. While the bushings 197 enable some realignment of the printed circuit board 189 in the plane of the printed circuit board 189, when the connectors 202 and 203 are being coupled, most of the realigning movement can occur in the directions shown by arrows A. Thus, when the mounting member 59 is moved from the open or non-operating position of FIG. 5 to the operating position of FIG. 1, the connection between two circuit parts (shown by 31 and 59 in FIG. 15) of the circuitry is made. The microprocessor 74 on the printed circuit board 73 is connected to the connector 203. The lithium battery 77 is used to maintain the memory of the microprocessor 75 when connectors 202 are uncoupled and/or when the handle 32 is detached. The connector 202 is connected to the portion of the circuitry on the printed circuit board 189. The use of the connectors 202 and 203 enables ready access and allows servicing of the labeler 30 while maintaining the memory of the microprocessor 74. In addition, the need for numerous individual electrical conductors and complexity are eliminated.

Figure 15:
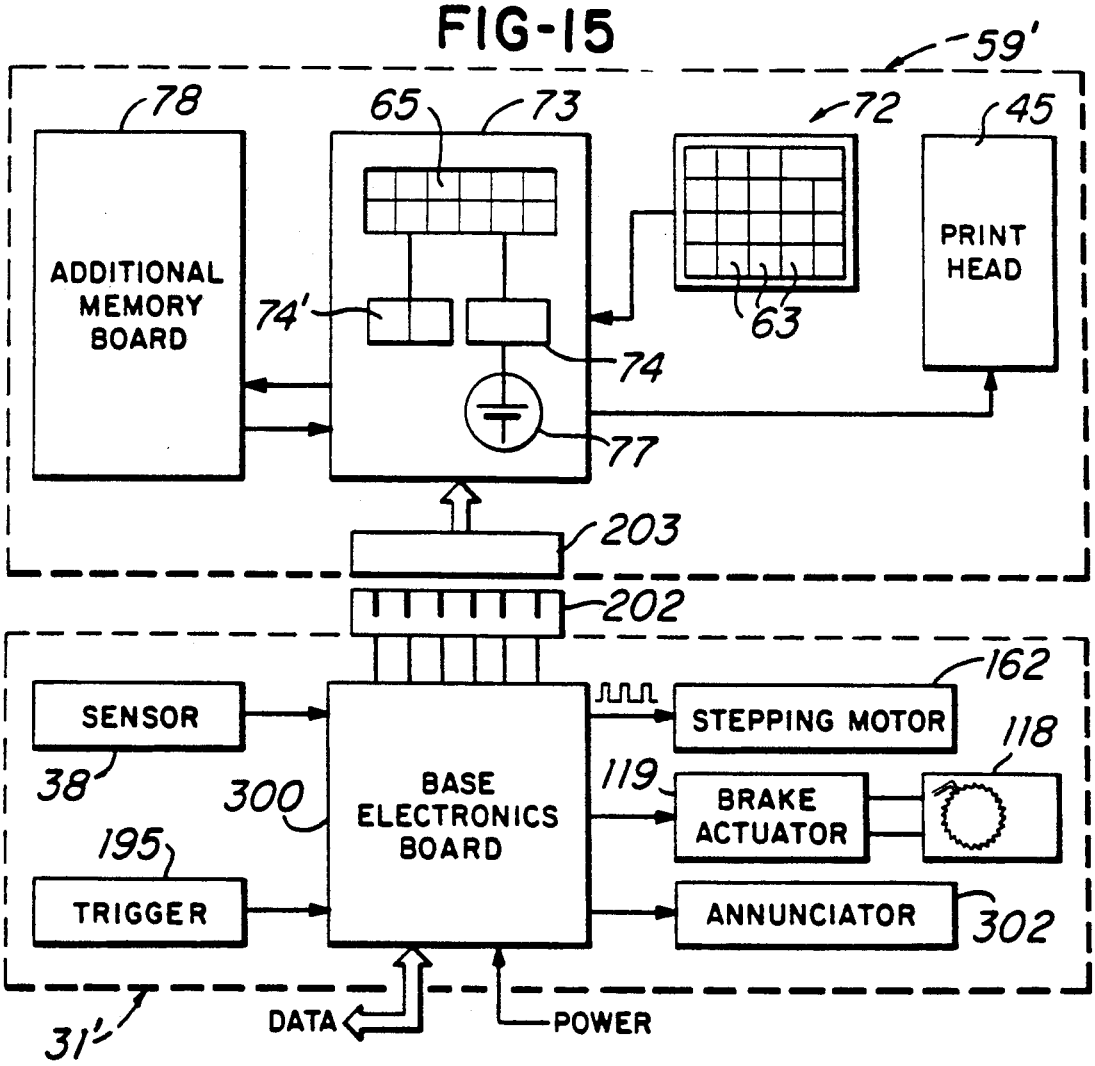
FIG. 15 is a block diagram of the labeler.

Referring now to FIG. 15, many of the various components illustrated in the drawing figures are illustrated in block diagram form in FIG. 15. The components mounted on the mounting member 59 and on the housing 31 are grouped separately, with the components mounted on the mounting member 59 being enclosed by the block 59' and the components mounted in the housing 31 being enclosed by the block 31'. The connectors 202 and 203 disposed on the respective housing 31 and mounting member 59 are illustrated to show the interconnection between the components on the housing 31 and the mounting member 59. The housing 31 contains a base electronics board 300 that serves to receive signals from the sensor 38, the trigger 195, preferably located in the handle of the labeler (FIG. 1), as well as data and power. Typically the data may be received from a central computer via a suitable connector mounted on the housing 31, and power may be received from a battery contained within a removable handle affixed to the housing 31. The data applied to the labeler may be received from a central computer and may contain data defining, for example, the type of label to be printed, the format of the label, the font of the characters to be printed as well as currency symbols and price and merchandise identifying codes.

The base electronics board 300 also contains drivers for driving the web avancing motor 162 and a brake actuator or solenoid 119 that releases a brake mechanism 118 that maintains the web C in a fixed position relative to the print head 45 except essentially when the motor 162 is energized to prevent the web C from shifting with respect to the print head 45, particularly when the label is being applied to an article of merchandise. An annunciator 302, which may be an audible beeper or the like, is used to provide prompts to the operator during the programming and operation of the labeler.

While the housing 31 contains most of the circuitry for performing the web advance and braking functions, the mounting member 59 contains most of the circuitry for providing the data inputting, computational and printing functions. Data received via the key pads 63 of the keyboard 72 is applied to the circuit board 73 which contains the display 65 and the microprocessor 74 as well as additional circuitry generally indicated as 74' and a backup battery 77. Based on the data received via the keyboard 72 and other data received from the base electronics board 300 in the housing 31 via the connectors 202 and 203, the circuitry on the board 73 energizes the print head 45 in the appropriate sequence to print the desired information on the web C. The additional memory board 78 is optional and is utilized only when additional features, such as, for example, the ability to print bar codes and non-standard characters is desired.

The mounting member 59 is intended to be maintained in its closed position except for servicing. The tabs 105 have aligned holes 209 in which shiftable posts 210 and 211 are received. The post 210 has a projection 212 which fits into a pocket 213 on the post 211, and the post 211 has a projection 214 which fits into a pocket 215 on the post 210. A screw 216 passes through an oversize hole in printed circuit board 189 and a hole 217 in the subframe section 160 and is threadly received in the end portion of the post 211. A screw 218 passes through a hole in the other subframe section 160 and is threaded into the end portion of the post 210. By rotating the screws 216 and 218 in one direction, the posts 210 and 211 are moved away from each other into the holes 209 in the tabs 105 to lock the mounting member 59 in its operating position. By rotating the screws 216 and 218 in the other direction, the posts 210 and 211 are moved toward each other out of the holes 209 to unlock the mounting member 59.

Figure 6A:
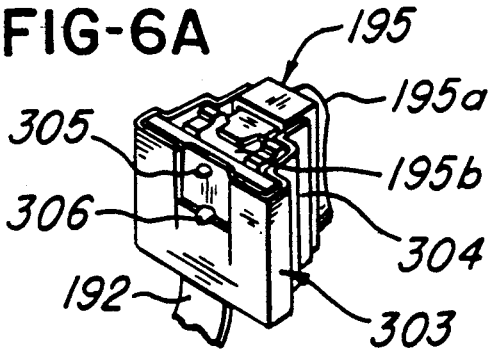
FIG. 6A is a perspective view of the trigger switch and a conductive member for dissipating electrostatic charges to the user.
Figure 6B:
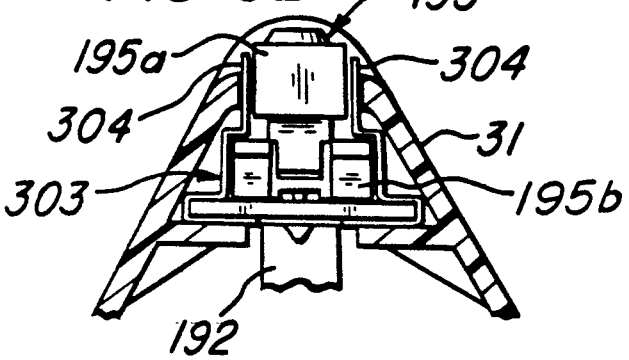
FIG. 6B is a partly sectional view through the labeler housing and looking downwardly and showing the trigger switch and an electrostatic eliminator.

With reference to FIGS. 6A and 6B, the switch 195 is mounted in the housing 31. The switch 195 includes a manually operable switch button **195*a* and a switch body 195*b*. The switch 195 is normally open but is closed when the switch button 195*a* is depressed or actuated. An electrostatic charge eliminating device in the form of a conductive member generally indicated at 303 extends about the switch body 195*b* and terminates at two parallel side portions 304 which straddle the switch button 195*a*. The switch body 195*b* has two contacts 305 and 306 connected respectively to the microprocessor input and to the negative side of the battery powered circuit on the ribbon conductor 192. The conductive member 303 is electrically connected to the negative side contact 306, as by soldering. When the user's index finger depresses the switch button 195*a* to initiate operation of the labeler, the user's index finger also contacts or at least comes into close proximity to the conductive member 303, and this causes the electrostatic charge in the labeler to be drained off to the human user. The conductive material 303 is actually a conductive extension from the negative side of the circuit to the user. The draining or dissipation of the charge prevents the accumulation of a large electrostatic charge which can cause arcing in the electronic circuit of the labeler which can result in damage to the labeler circuitry and/or loss of memory. Also, the invention results in the dissipation of electrostatic charges while they are still small enough so that damage to the circuitry does not result and while still at a safe level for the user. Thus, high electrostatic voltage arcs detrimental to the circuitry are obviated. While it is preferred that the side portions 304 extend far enough so that upon depression of the switch button 195*a*, the user's index finger actually contacts the side portions 305 and 306, it is adequate that the index finger comes into close proximity to the side portions 304, and by "close proximity" is meant close enough to result in the detrimental electrostatic charge being drained away into the user. If desired, the conductive member 303 can be located so that it contacts the user's hand at other than the index finger or is suitably wired to the user. The conductive member 303** can even be slightly electrically insulated from the user just so long as the insulation is slight enough to enable the electrostatic charge to drain through the insulation to the user's body.

Other embodiments and modifications of the invention will suggest themselves to those skilled in the art, and all such of these as come within the spirit of this invention are included within its scope as best defined by the appended claims.

We claim:

1. A hand-held labeler for printing and applying labels releasably secured to a carrier web of a composite label web, comprising: a housing having a handle, means on the housing for supporting a supply roll of a composite label web, a thermal print head, a platen roll cooperable with the print head for effecting printing on the labels, means for providing a path for the composite label web from the supply roll to between the print head and the platen roll, means for delaminating printed labels from the carrier web, means for applying printed labels, means for advancing the carrier web to effect delamination of a printed label and to advance the printed label into label applying relationship with the label applying means, means for applying braking force to the platen roll to prevent movement of the carrier web except essentially when the carrier web is being advance by the advancing means, wherein the means for providing a path includes two rollers, the rollers being arranged to contact and guide the advancing composite label web between the supply roll and the platen roll, and a wiper disposed in a space between the rollers and projecting through a flat plane between the peripheries of the rollers so that the labels wipe against the wiper during the advance of the composite label web.

2. A hand-held labeler as defined in claim 1, wherein the wiper comprises a low permeable urethane material.

3. A hand-held labeler as defined in claim 1, wherein the wiper comprises urethane material.

4. A hand-held labeler for printing and applying labels releasably secured to a carrier web of a composite label web, comprising: a housing having a handle, means on the housing for supporting a supply roll of a composite label web, a thermal print head, a platen roll cooperable with the print head for effecting printing on the labels, means for providing a path for the composite label web from the supply roll to between the print head and the platen roll, means for delaminating printed labels from the carrier web, means for applying printed labels, means for advancing the carrier web to effect delamination of a printed label and to advance the printed label into label applying relationship with the label applying means, means for applying braking force to the platen roll to prevent movement of the carrier web except essentially when the carrier web is being advanced by the advancing means, wherein the means for providing a path includes two rollers, the rollers being arranged to contact and guide the advancing composite label web between the supply roll and the platen roll, and a wiper disposed in a space between the rollers, the wiper having an inclined surface, wherein only a portion of the inclined surface projects beyond a flat plane between the peripheries of the rollers so that the labels wipe against the wiper during the advance of the composite label web, and wherein the inclined surface provides for gradual entry of the composite label web to facilitate threading of the composite label web.

5. A hand-held labeler as defined in claim 4, wherein the wiper comprises a low permeable urethane material.

6. A hand-held labeler as defined in claim 4, wherein the wiper comprises urethane material.

7. A hand-held labeler for printing and applying labels releasably secured to a carrier web of a composite label web, comprising: a housing having a handle, means on the housing for supporting a supply roll of a composite label web, a thermal print head, a platen roll cooperable with the print head for effecting printing on the labels, means for providing a path for the composite label web from the supply roll to between the print head and the platen roll, wherein the path includes means for providing a gradual transition through not less than 85°, means for delaminating printed labels from the carrier web, means for applying printed labels, means for advancing the carrier web to effect delamination of a printed label and to advance the printed label into label applying relationship with the label applying means, means for applying braking force to the platen roll to prevent movement of the carrier web except essentially when the carrier web is being advanced by the advancing means, wherein the means for providing a gradual transition includes two rollers, wherein the path is generally curved along said gradual transition and the radius of the curved path is at least 18 millimeters, the rollers being arranged to contact and guide the advancing composite label web between the supply roll and the platen roll, and a wiper disposed in a space between the rollers and projecting through a flat plane between the peripheries of the rollers so that the labels wipe against the wiper during the advance of the composite label web.

8. A hand-held labeler as defined in claim 7, wherein the wiper comprises a low permeable urethane material.

9. A hand-held labeler as defined in claim 7, wherein the wiper comprises urethane material.

* * * * *

UNITED STATES PATENT AND TRADEMARK OFFICE

CERTIFICATE OF CORRECTION

PATENT NO. : 5,009,739

DATED : April 23, 1991

INVENTOR(S) : Brent E. Goodwin et al

It is certified that error appears in the above-identified patent and that said Letters Patent is hereby corrected as shown below:

Column 6, line 54, "125" should be --126--, and "126" should be --125--. Column 12, line 5, "advance" should be --advanced--.

Signed and Sealed this

Eleventh Day of May, 1993

*Attest:*

Michael K. Kirk

MICHAEL K. KIRK

*Attesting Officer*

*Acting Commissioner of Patents and Trademarks*